US006223677B1

(12) United States Patent
Hall et al.

(10) Patent No.: US 6,223,677 B1
(45) Date of Patent: May 1, 2001

(54) RIGID INFLATABLE BOAT WITH ADAPTABLE HULL

(75) Inventors: David G. Hall, Eden Prairie, MN (US); Thomas R. Gessner, Naples, FL (US)

(73) Assignee: Vanguard Boats, Inc., Bloomington, MN (US)

( * ) Notice: Subject to any disclaimer, the term of this patent is extended or adjusted under 35 U.S.C. 154(b) by 0 days.

(21) Appl. No.: 09/422,549

(22) Filed: Oct. 21, 1999

(51) Int. Cl.[7] ..... B63B 7/00
(52) U.S. Cl. ..... 114/345; 114/364
(58) Field of Search ..... 114/123, 345, 114/352, 355, 356

(56) References Cited

U.S. PATENT DOCUMENTS

| | | | | |
|---|---|---|---|---|
| 1,667,561 | * | 4/1928 | Mediavilla | 114/79 R |
| 1,736,157 | * | 11/1929 | Harter | 114/123 |
| 1,930,770 | * | 10/1933 | Pritchard | 114/79 R |
| 2,057,574 | * | 10/1936 | Hopp | 114/355 |
| 2,150,958 | * | 3/1939 | Alexander | 114/356 |
| 2,494,804 | * | 1/1950 | Gabriel | 114/123 |
| 4,498,413 | | 2/1985 | Cochran . | |
| 4,597,355 | | 7/1986 | Kirby . | |
| 4,628,854 | | 12/1986 | Harding . | |
| 4,660,497 | | 4/1987 | Cochran . | |
| 4,724,792 | | 2/1988 | Cochran . | |
| 4,779,555 | | 10/1988 | Hong . | |
| 4,807,556 | | 2/1989 | Hillier . | |
| 4,928,619 | | 5/1990 | Cochran . | |
| 4,934,301 | | 6/1990 | Harding . | |
| 4,938,162 | | 7/1990 | Hanlon . | |
| 4,942,838 | | 7/1990 | Boyer et al. . | |
| 4,964,821 | | 10/1990 | Tafoya . | |
| 4,976,213 | | 12/1990 | Smith . | |
| 5,033,401 | | 7/1991 | Bartlett . | |
| 5,056,453 | | 10/1991 | Wright . | |
| 5,131,348 | | 7/1992 | Roy . | |
| 5,170,742 | * | 12/1992 | Roskelley | 114/366 |
| 5,184,566 | | 2/1993 | Cochran . | |
| 5,228,407 | | 7/1993 | Cummer et al. . | |
| 5,282,436 | | 2/1994 | Hansen . | |
| 5,517,939 | | 5/1996 | Harman et al. . | |
| 5,522,338 | | 6/1996 | Eilert et al. . | |
| 5,584,260 | | 12/1996 | Hemphill . | |
| 5,617,810 | | 4/1997 | Sauerwein . | |
| 5,647,297 | | 7/1997 | Hansen . | |
| 5,651,328 | * | 7/1997 | Elkington | 114/345 |
| 5,819,682 | | 10/1998 | Pestel . | |
| 5,870,965 | | 2/1999 | Hansen . | |
| 5,943,978 | | 8/1999 | Garnier . | |

OTHER PUBLICATIONS

Patent Assignee Search Report—Derwent's World Patent Index—63 listings with English Abstracts.

* cited by examiner

*Primary Examiner*—S. Joseph Morano
*Assistant Examiner*—Andrew Wright
(74) *Attorney, Agent, or Firm*—Faegre & Benson, LLP

(57) ABSTRACT

An adaptable, multi-purpose boat includes a rigid hull and a buoyant sponson removably connected to the rigid hull. The rigid hull includes a plurality of rigid ribs that are each constructed from a pair of sidewall portions and a 'V' angled keel portion, and are connected to form sides, a keel, and a 'V' angled bottom interposed between the sides and the keel. The plurality of rigid ribs includes a plurality of hull connectors arranged in a predetermined organized pattern, such that a variety of external components may be removably fastened to the boat using at least one of the plurality of hull connectors. As a result, the boat is repeatedly reconfigurable to adapt to multiple post-fabrication purposes.

8 Claims, 14 Drawing Sheets

RIGID INFLATABLE BOAT WITH ADAPTABLE HULL

FIELD OF THE INVENTION

This invention relates to rigid inflatable boats ("RIBs") having rigid hulls connected to inflatable sponsons, and in particular to RIBs having an adaptable hull design.

BACKGROUND OF THE INVENTION

Inflatable boats, such as those used as tenders and life rafts, have been on the market since the late 1930's. These boats have the advantage of being light weight, mobile and collapsible, making them convenient to carry along, especially for use as emergency vessels. Inflatable boats may include an inflatable keel covered by a rigid or semi-rigid floor, or they may just include a flexible floor.

Inflatable boats have the disadvantage of being flexible, making them difficult to lift, especially using a four-point lifting system or when carrying a load. Therefore, although launching of the inflatable boats is efficient and convenient, recovery of these boats back to a ship or other transport system after use is difficult and sometime impossible. Flexibility also results in inefficient use of fuel, as the boat bends with the waves instead of moving over the waves, making their usable distance on a fixed amount of fuel very limited. In addition, conventional materials for constructing inflatable boats tend to be highly vulnerable to ultra-violet radiation and solvents, easily abradable and limited in shelf life due to breakdown of the material over time. Other disadvantages of inflatable boats include the inability to effectively carry gear within the boat or to mount gear on the boat.

Rigid inflatable boats, also known as RIBs, typically have a rigid hull constructed of fiberglass or aluminum, surrounded by and connected to an inflatable sponson or tube. The hull is usually designed as a planing hull allowing the boat to effectively ride over the waves, thereby increasing the fuel efficiency, stability and seaworthiness of the boat. RIBs are currently available for commercial, safety, rescue, diving and leisure activities. They can include inboard or outboard motors, or can be jet powered. RIBs can have open decks, driving consoles, and wheel-houses or cabins, depending on the size of the boat and the needs of the boater.

Although RIBs are more stable and durable than inflatable boats, they are heavier and less compact, requiring more storage and transport space. In addition, although RIBs are available in numerous different sizes and styles to meet many different boating applications, once a RIB is purchased for a specific application its configuration is set by that application. Only minor changes to the boat's configuration are generally possible after the boat has been fabricated, such as moving seats, changing the outboard motor, or relocating gear within the boat. Other drawbacks to standard RIBs include the use of fiberglass hulls to achieve reasonable boat weights, the use of rigid hull bottoms without rigid sidewalls in many instances to reduce weight, and non-portability due to overall size and weight of the RIB and its components.

To meet current needs within the boating community, especially in the military, rescue and safety areas, a light weight, adaptable rigid hulled boat is needed. Such boat should also be small enough for transport by search and rescue transportation, such as helicopters, boats and other vehicles.

SUMMARY OF THE INVENTION

An adaptable, multi-purpose light weight boat having a rigid hull and a buoyant sponson removably connected to the hull is provided by the present invention. The rigid hull includes a plurality of rigid ribs that are each constructed from a pair of sidewall portions and a 'V' angled keel portion, and are connected to form sides, a keel, and a 'V' angled bottom interposed between the sides and the keel. The plurality of rigid ribs includes a plurality of hull connectors arranged in a predetermined organized pattern, such that a variety of external components may be removably fastened to the boat using at least one of the plurality of hull connectors. As a result, the boat is repeatedly reconfigurable to adapt to multiple post-fabrication purposes. A method for reconfiguring such an adaptable boat using the plurality of hull connectors is also provided.

The rigid ribs are connected by thin plates, all preferably formed from aluminum, resulting in a light weight but very strong and durable hull capable of withstanding rough seas and environmental conditions, and yet still easily lifted and transported with a minimum of effort and in a minimum of storage space. The buoyant sponson includes a tube that is generally 'U' shaped in plan, preferably formed from polyurethane, and filled with a buoyant substance such as air and/or foam. The boat may be provided with multiple sponsons that are interchangeable for adapting the boat to a specific application.

DETAILED DESCRIPTION OF THE INVENTION

Figure 1:
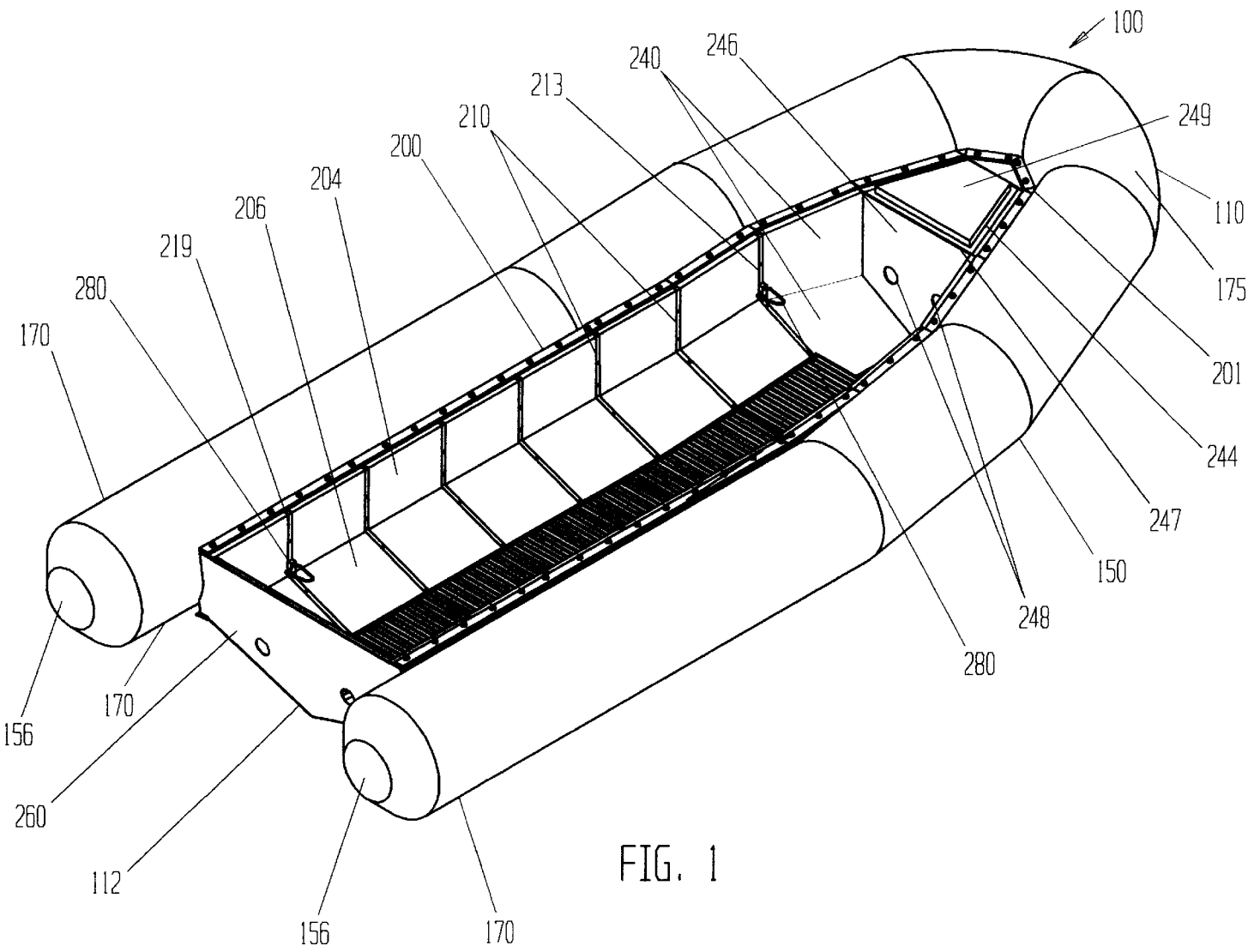
FIG. 1 is a perspective view of an adaptable boat in accordance with the present invention.

With reference to the attached Figures, it is to be understood that like components are labeled with like numerals throughout the several Figures. FIG. 1 is a perspective view of an adaptable, multi-purpose boat 100 in accordance with the present invention. The boat 100 has two main components: a rigid hull 200 and a buoyant sponson 150 removably connected to the hull 200.

Figure 2:
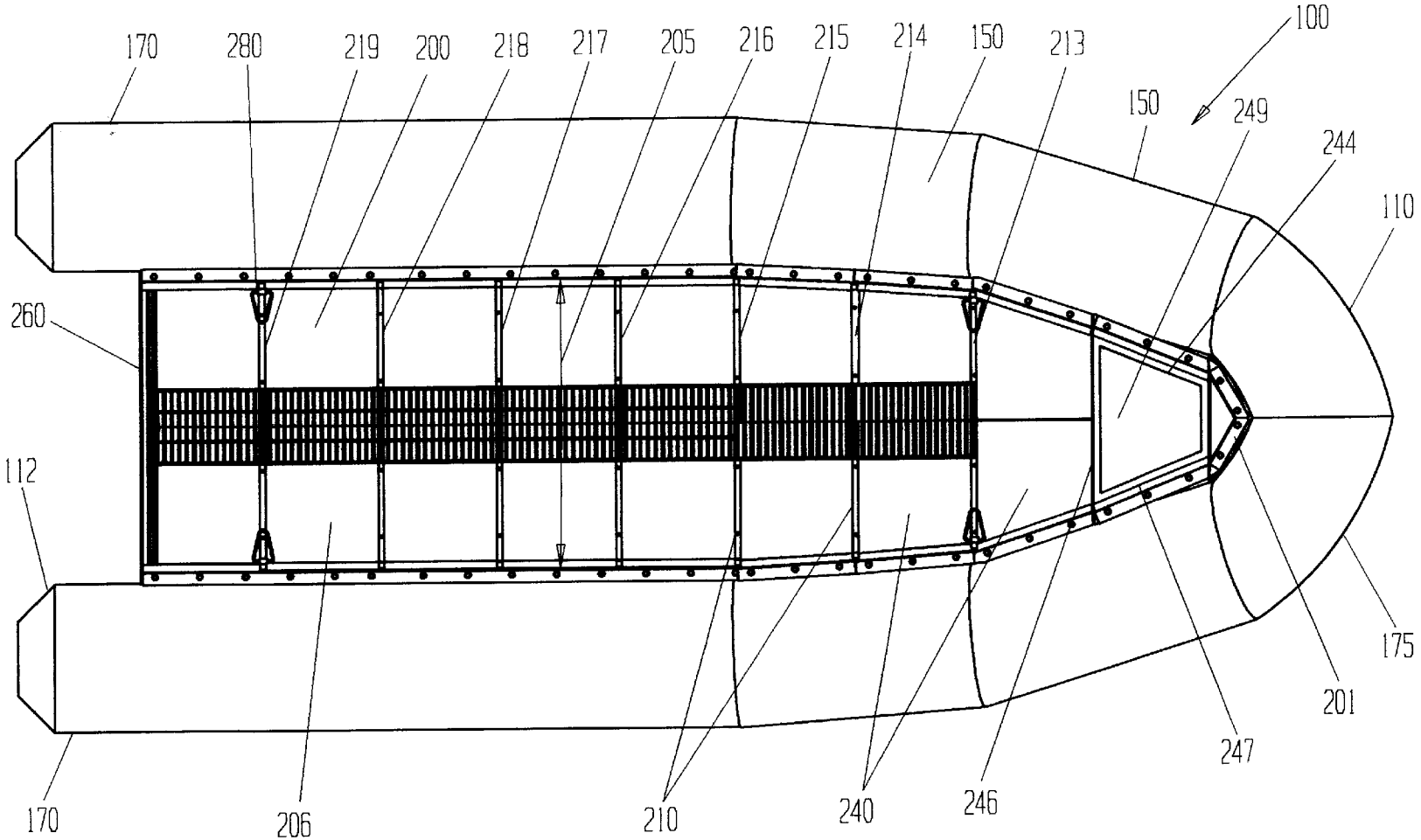
FIG. 2 is a top plan view of the boat in FIG. 1.
Figure 3:
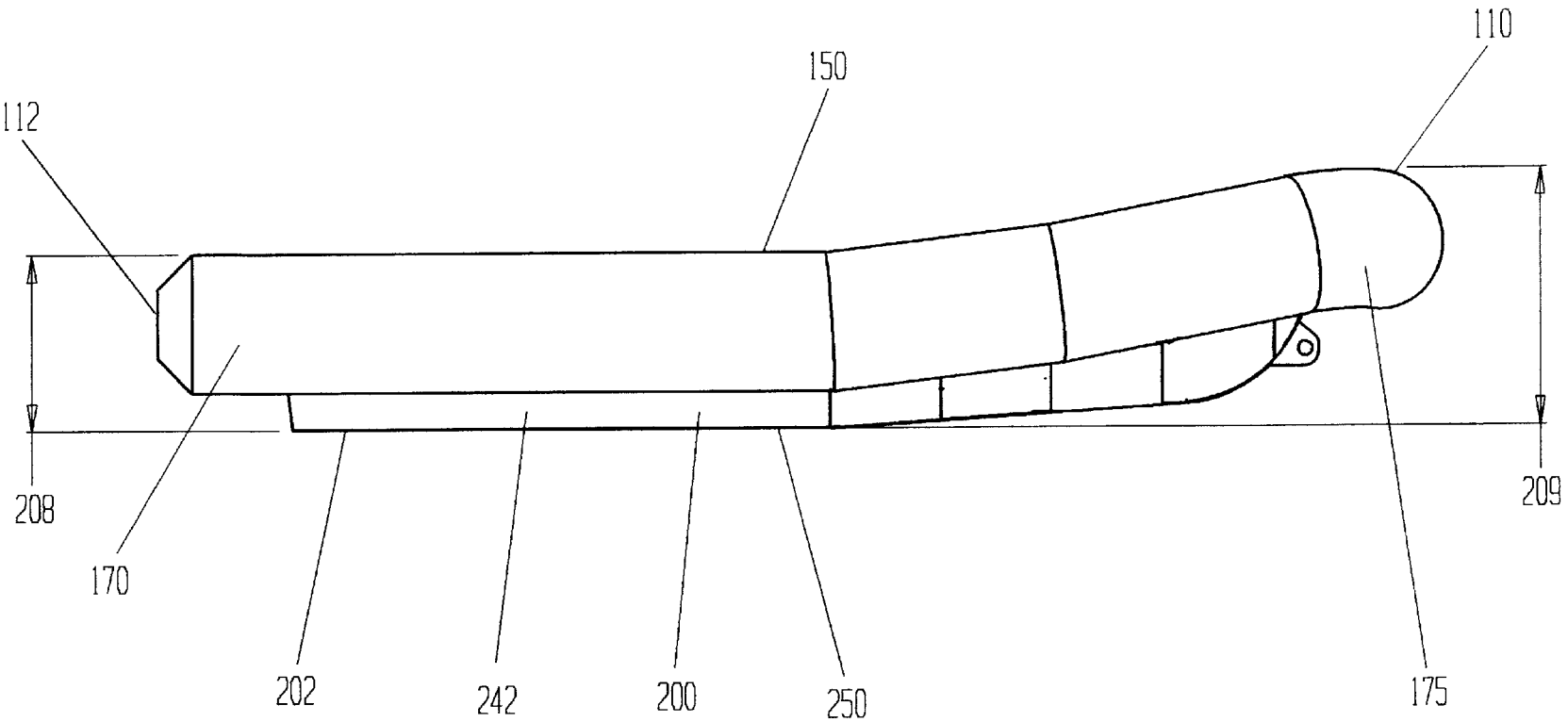
FIG. 3 is a side view of the boat in FIG. 1.
Figure 4:
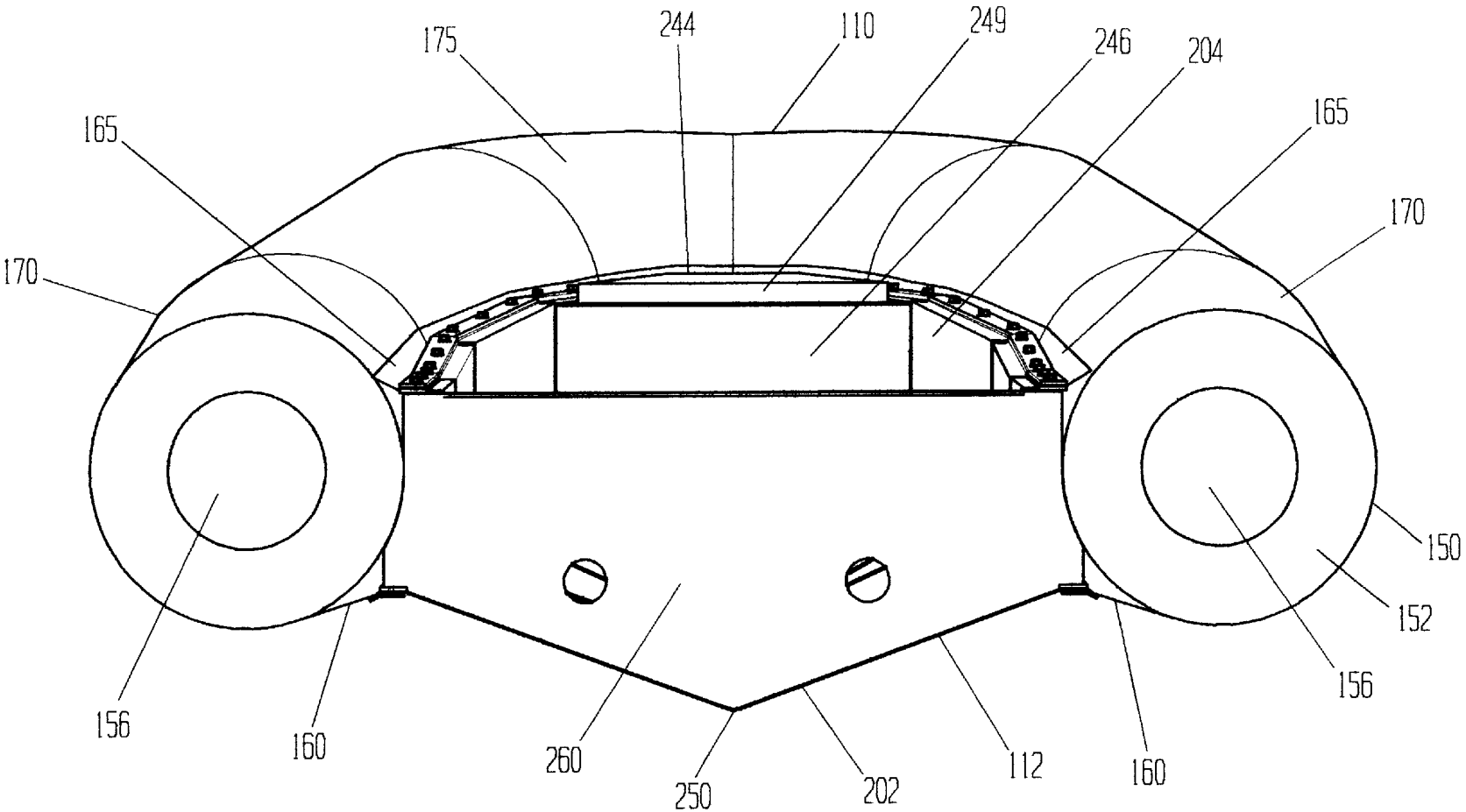
FIG. 4 is a back view of the boat in FIG. 1.

Now referring also to FIGS. 2–4, the sponson 150 is a generally 'U' shaped tube 155 filled with a buoyant substance. The tube 155 has a curved bow portion 175 forming the bow 110 of boat 100, and two straight side portions 170 that overhang the hull 200 at the stern 112 of boat 100. The tube 155 has a generally circular cross-section 152, which in one embodiment is about 1.67 feet in diameter. The tube 155 includes five inner sealed chambers (not shown), two in each side portion 170 and one at the bow portion 175. End caps 156 positioned at the aft ends of the side portions 170 seal the tube 155.

The tube 155 is preferably formed from polyurethane, which is resistant to solvents, fuel and ultra-violet radiation effects. The polyurethane is preferably extruded onto a nylon base fabric to form a extremely strong material. The polyurethane material may be heat welded together at seams from both sides creating an extremely strong bond that won't split apart. Portions of the tube 155 may be built up by the addition of more polyurethane material in order to increase the strength and durability in high wear or high stress locations. The polyurethane material may be produced in various colors or may be textured depending on the needs or desires of the customer. Polyurethane sponson tubes 155 such as those described above may be purchased from Wing Inflatables, P.O. Box 279, Arcata, Calif. It is to be understood, however, that other sponson materials may also be used to construct the tube 155, and such materials are also within the spirit and scope of the present invention, In one embodiment, the buoyant substance filling the tube 155 is air, making the boat 100 a member of the rigid inflatable class of boats, or RIBs. Preferably, the air-filled sponson 150 is attached and detached in a semi-inflated state, which gives the sponson 150 both the structure and flexibility needed to handling easy during attachment and detachment. The air-filled sponson 150 is easily transported and stored in its deflated state, even when attached to the hull 200. Damage to the air-filled sponson 150 may result in loss of air in a portion of the tube 155, such as one of the five internal chambers. However, as the remaining chambers are sealed, the other chambers would typically be unaffected and would maintain buoyancy of the boat 100. In addition, the preferable structure of the hull 200, as described below, also has a level of buoyancy without the sponson 150.

In another embodiment, the buoyant substance filling the tube 155 is a buoyant solid material, including but not limited to foam. In particular, the sponson 150 preferably includes a tube 155 filled with foam rods (not shown), such as closed cell 220 etha foam rods. It is to be understood, however, that other buoyant solid materials and other types of foam, including injectable foam, could also be used in keeping with the spirit and scope of the present invention. The foam rods are placed into the chambers of the tube 155 until the tube 155 becomes relatively solid and is filled to about 80% of the tube's buoyancy volume. The foam is then sealed in the tube 155. Any slack remaining in the tube 155 is then taken up by partial inflation of the tube 155, thus filling the remaining 20% buoyancy volume. The foam-filled sponson 150 is preferably attached and detached from the hull 200 in a deflated state, in order to provide enough flexibility in the tube 155 to easily manage the attachment/detachment procedure.

As is apparent, the sponson 150 filled with buoyant solid material is less easily transported or stored than an air-filled sponson 150, since it is not readily compactable. However, the advantages of using buoyant solid material may be more critical in certain boating applications than the need for compactness. These advantages include, but are not limited to, resistance to loss of buoyancy due to breach of the tube 155, such as by puncturing or tearing, which may occur when the boat is used in rough seas around other objects, is in contact with sharp or jagged objects, or used in presence of firearms. In the embodiment described above, the foam-filled sponson 150 retains over 80% of its butoyancy after the loss of the inflating air. The removable foam-filled sponson 150 is interchangeable with the air-filled sponson 150, allowing a user to adapt the boat 100 to specific needs on a mission-by-mission basis.

As best shown in FIG. 4, the sponson 150 connects to the hull 200 by a plurality of upper 165 and lower 160 material flaps. Detailed discussion of this connection is presented below.

The hull 200 includes an angled vee-bottom 202 whose bottom-most portion is a keel 250, sides 204 extending up from the vee-bottom 202, and a transom 260 extending across the stern 112 connecting the sides 204. The hull 200 has a generally rounded bow 201 and a width 205 that expands from the bow 201 to about amidships (or the midpoint between the bow 110 and the stern 112), after which the width 205 remains substantially constant up to the transom 260. In one embodiment, the fixed width 205, or beam of the hull, is about 3.5 feet, and the hull is about 12.7 feet long. With the buoyant sponson 150 attached, the overall boat is about 6.8 feet wide and about 15.5 feet long.

The hull 200 is constructed from a plurality of ribs 210 connected together by exterior plates 242 forming the vee-bottom 202, and interior plates 240 forming the sides 204 and lower surface, hereinafter referred to as a deck 206, which is the inside floor of the boat 100. The deck 206 is synclinal, meaning that it slopes from two opposites directions, such as the sides 204, downward toward a common point or line, following the angle of the vee-bottom 202. The hull 200 is preferably formed from aluminum, with the interior and exterior plates 240, 242 preferably about ⅛ inch thick.

In one embodiment, a flat walking surface 207 is placed over the center portion of the deck 206 along most of the length of the hull 200. The flat walking surface 207 provides a safer and more comfortable walking area for users of the boat 100. The walking surface 207 may be formed as a grate or grill, as shown in FIGS. 1 and 2, or may be formed from other suitable materials including, but not limited to, solid plate, expanded metal, perforated metal, rubberized grid, or other open-work material. Use of grating or other open-work material allows water to pass through the walking surface 207 into the trough-like center of the synclinal deck 206 under the walking surface 207. By elevating the walking area above a bilge area where the water pools within the boat 100, objects placed on the deck 206 stay drier, users stay drier, and movement within the boat 100 is safer.

Formed at the bow 201 of the hull 200 is a compartment 244 useful for retaining loose objects stored within the boat 100. The compartment 244 includes an aft plate 246 spanning the width 205 of the hull 200, and a cover plate 247 positioned at the top of the sides 204 surrounding the compartment 244. An openable hatch 249 that is preferably hingeably connected to the cover plate 247 provides access into the enclosed space of the compartment 244. Drainage holes 248 may also be provided in aft plate 246, as shown in FIG. 1, to facilitate removal of water that enters the compartment 244.

The angled vee-bottom 202 of the hull 200 is a deep 'V' shape across the width 205, or athwartships, at the bow 110 that becomes a shallow 'V' shape toward the stem (as shown in FIG. 4). Additionally, as shown in FIG. 3, the keel 250 of the vee-bottom 202 is generally flat in side profile from the stem to amidships, angles upward from amidships toward the bow and curves upward at the bow 110. The stem height 208 of boat 100 is about 2.1 feet to the top of the sponson 150, and the bow height 209 is about 3.1 feet. As a result, the hull 200 performs as a planing hull that lifts and skims over the surface of the water at sufficient speed, instead of as a displacement hull that pushes the water aside, thus increasing the fuel efficiency of the boat 100 resulting in a greater usable distance on a fixed supply of fuel. In addition, the deep 'V' shape provides improved tracking by avoiding or reducing skidding in turns. A tow eye 120 is mounted to the keel 250 at the bow 201 providing a connection point for tow ropes, or other necessary items.

As shown in FIG. 1, the ribs 210 define the structure of the hull 200. In the embodiment shown, there are nine ribs 210, numbered 211 to 2i9 from the bow 201 to the stern 112, plus the transom 260. Referring now to FIGS. 5–8, since all the ribs 210 include the same basic elements, these elements will be discussed with respect to a representative rib 215, shown in FIG. 8.

Figure 8:
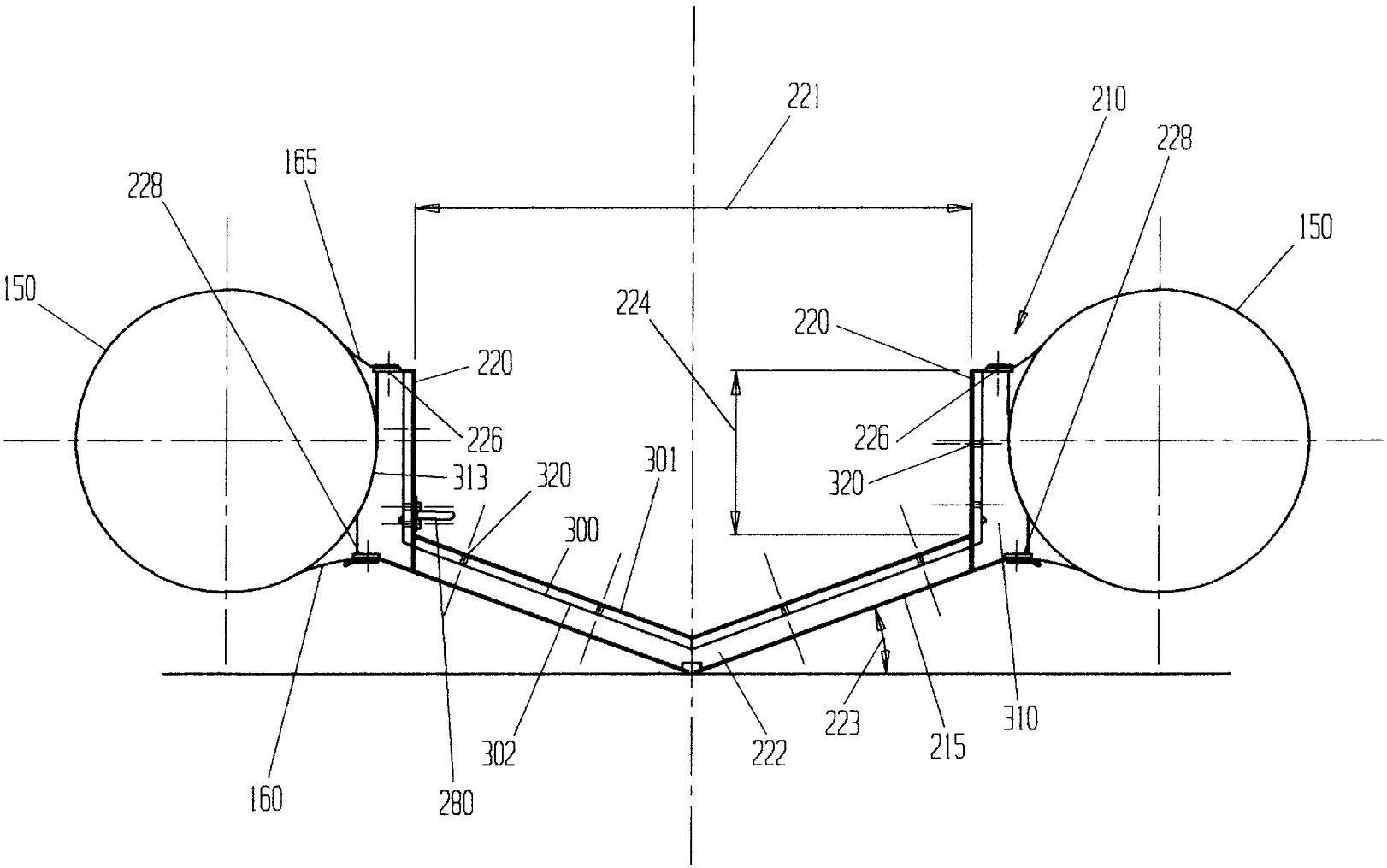
FIG. 8 is a front view of a rib representing rib numbers three through nine of the boat in FIG. 1.

Referring now to FIG. 8, rib 215 includes an angled keel portion 222 and two sidewall portions 220 extending upward from the keel portion 222. The lowermost section of the angled keel portion 222 connects to a keel bar 252,which will be discussed in more detail below. The angled keel portion 222 has a dead rise angle 223, which is the angle at which the vee-bottom 202 rises with respect to the horizontal creating the 'V' shaped hull described above. In the embodiment shown, the dead rise angle 223 varies from about 51.25° at the first rib 211 down to about 20° at the fourth rib 214, and remains at about 20° aft to the transom 260. It is to be understood, however, that the dead rise angles 223 may change depending on factors such as boat length, boat width, running speeds for which the boat is designed or specific applications for which the boat is intended.

A distance 221 between the two sidewall portions 220 of the rib 215 determines the interior width 205 of the hull 200 at that rib 215. In the embodiment shown, this distance 221 varies from about 10 inches at the first rib 211 to about 37 inches at the widest point of the boat, which starts at the fifth rib 215 and extends aft to the transom 260 An inside height 224 of the sidewall portions 220 provides the height of the sides 204. In the embodiment shown, this height 224 remains about 11 inches from the third rib 213 aft to the transom 260. The height 224 at the first and second ribs 211 and 212 is 8.6 inches and 13.4 inches, respectively, differing from the norm due to the upward curvature of the keel 250 at bow 110 of boat 100.

Figure 9:
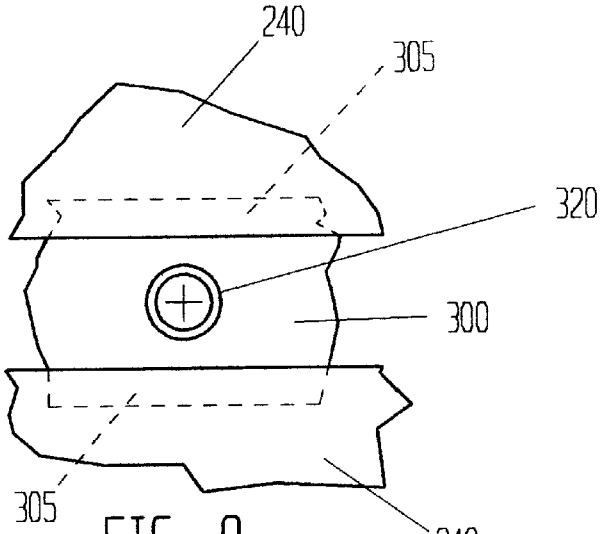
FIG. 9 is a top sectional view of a hull connector.
Figure 10:
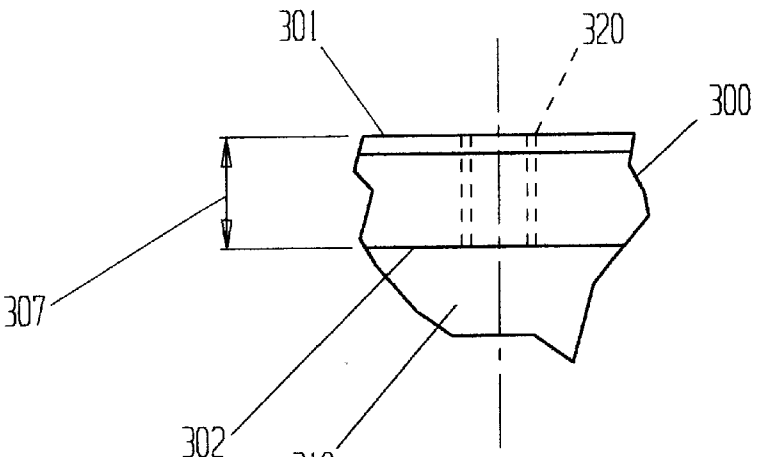
FIG. 10 is a front sectional view of the hull connector in FIG. 9.
Figure 11:
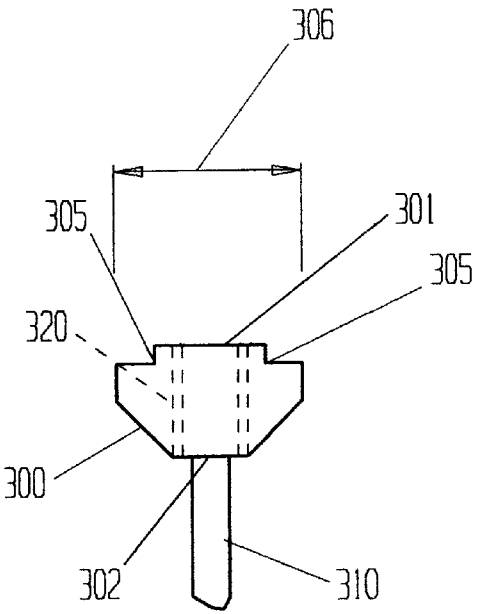
FIG. 11 is a side sectional view of the hull connector in FIGS. 9 and 10.

Referring now also to FIGS. 9–11, the third rib 213 to the ninth rib 219 (as represented by rib 215) each include a profile bar 300 that extends down both sidewall portions 220 and along the angled keel portion 222. The profile bar 300 is preferably formed from aluminum, however, other suitable materials may also be used. Preferably, the profile bar 300 has a width 306 of about 1¼ inches and a height 307 of about ¾ inch. Attached to the outer surface 302 of the profile bar 300, using welding or other suitable attachment method, is a rib plate 310. The rib plate 310 also includes sidewall portions 312 and an angled keel portion 316 such that the rib plate 310 has a generally 'V' configuration with vertical sides. Preferably, the rib plate 310 is about 3⁄16 inch thick. The outside edge 313 of the sidewall portions 312 includes a profile configured to mate with the radius of the sponson 150.

Figure 13:
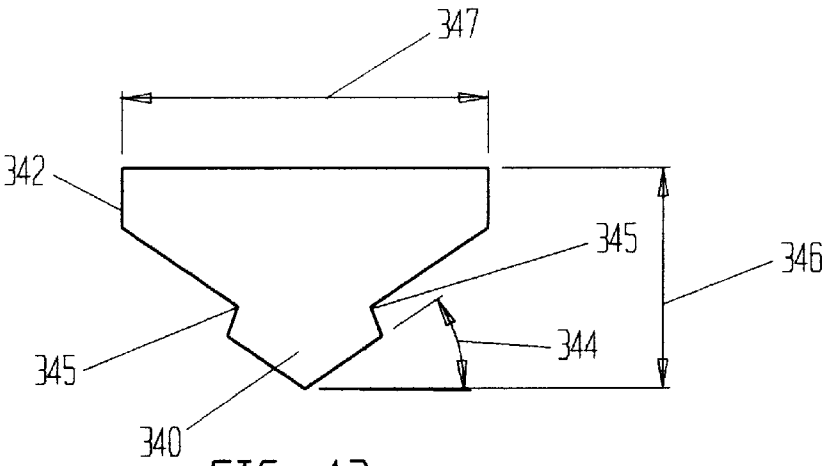
FIG. 13 is a cross-sectional view of the keel bar at the second rib.
Figure 12:
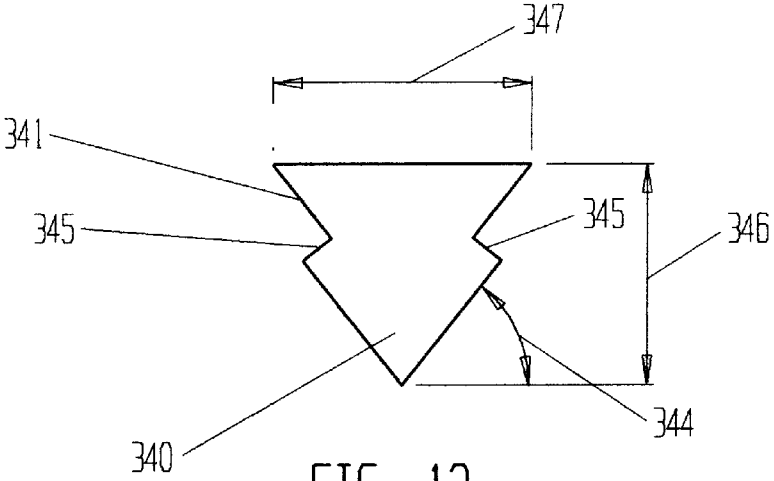
FIG. 12 is a cross-sectional view of the keel bar at the first rib.
Figure 14:
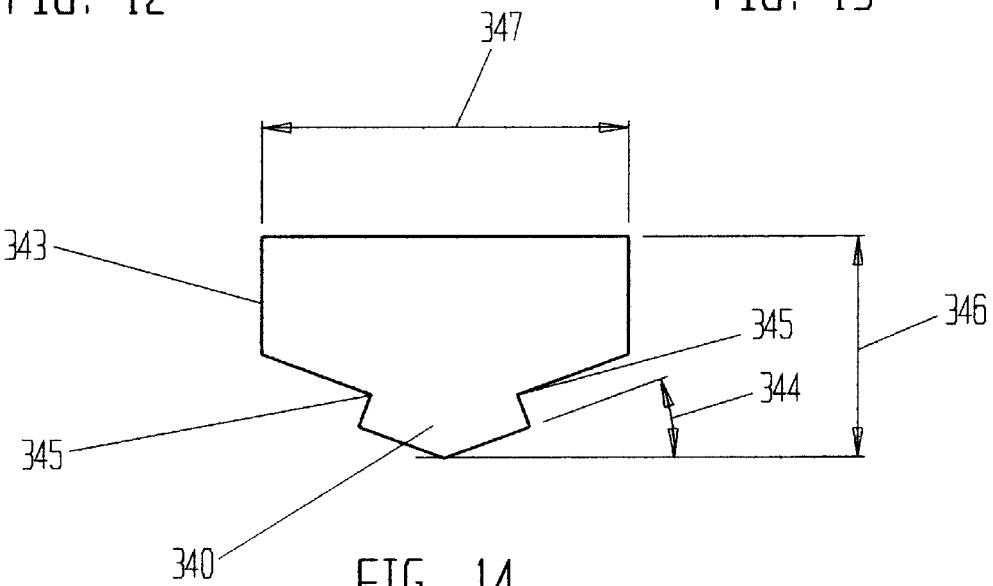
FIG. 14 is a cross-sectional view of the keel bar at rib numbers three through and the transom.

The profile bar 300 includes a pair of notches 305 formed in the inner surface 301. These notches 305 facilitate a smooth and uniform interior surface of hull 200 when plates 240 are attached, by welding or other suitable attachment methods, to each profile bar 300 at the notches 305 connecting the ribs 210 together. The profile bar 300 also preferably includes a plurality of connectors such as threaded inserts 320 mounted in the profile bar 300 and preferably evenly placed along both sidewall portions 303 and angled keel portion 304 of the profile bar 300. In the embodiment shown, eight threaded inserts 320 are included, two on each sidewall portion 303 and tour symmetrically placed on the synclinal angled keel portion 304. Each threaded inserts 320 is preferably formed from stainless steel, however, other suitable materials may also be used. Each threaded insert 320 is inset and attached to the profile bar 300, such as by epoxy, adhesive, or other suitable attachment method. In the event that a threaded insert 320 becomes damaged or for some other reason unusable, the threaded insert 320 may be removed and replaced. When not in use, the threaded inserts 320 may be protected by the insertion of threaded bolts or plugs (not shown). It is to be understood, however, that other types of connectors may be used in place of threaded inserts to provide a plurality of connection points along the interior of the hull 200. Such other types of connectors are also within the spirit and scope of the present invention As mentioned above, attached to the lowermost section of the rib 215 is keel bar 252. The keel bar 252 extends from the bow 201 to the transom 260 connecting the ribs 210 together. The keel bar 252 is preferably formed from aluminum, however, other suitable materials may also be used. Referring to FIGS. 12–14, detailed keel bar profiles 341, 342, and 343 are shown that correspond to the first rib, the second rib and the third through ninth ribs, respectively. Each keel bar profile 341, 342, 343, includes a 'V' angled base 340 having an angle 344 corresponding to the dead rise angle 223, which is about 51.25°, about 34°, and about 20°, respectively, in the embodiment shown. The angled base 340 also includes symmetrically placed notches 345 formed at the same angle 344. These notches 345 facilitate smooth attachment, by welding or other suitable attachment methods, of the keel bar 252 to the exterior plates 242 forming the vee-bottom 202 of hull 200. Each keel bar profile 341, 342, 343, also has a height 346 and width 347. In this embodiment, the height is ¾ inch for all keel bar profiles 341, 342, 343, and the width is ⅞ inch for profile 341 and 1¼ inches for profiles 342 and 343.

Figure 15:
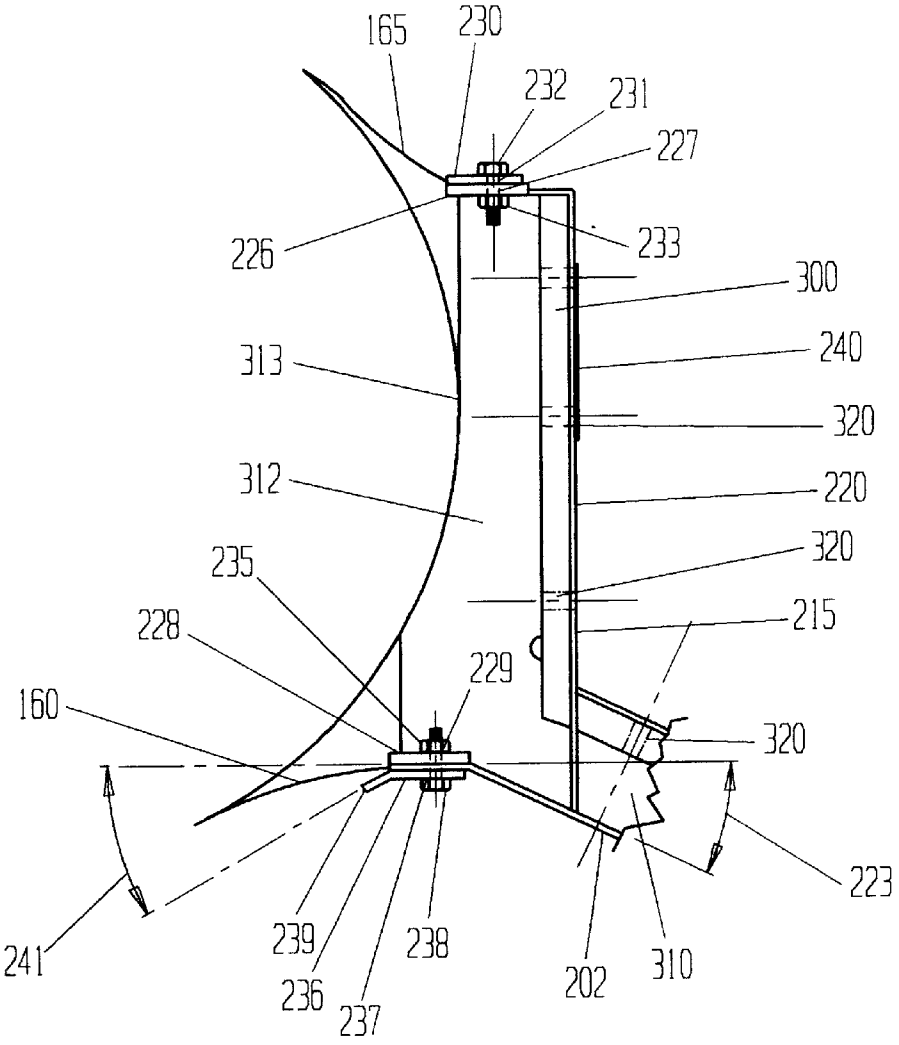
FIG. 15 is a side sectional detail view of the side showing attachment of the sponson to the hull.

As shown in FIG. 8, the ribs 210 are also connected by a top rail 226 and a bottom rail 228 attached to each of the ribs 210 at the top and bottom, respectively, of each of the rib plate sidewall portions 312. The top rail 226 and bottom rail 228 extend from the bow 201 to the stern 112 on both sides of the hull 200 to facilitate attachment of the sponson 150 to the hull. Referring now also to FIG. 15, a detailed view of sidewall portion 220 is shown with the sponson 150 attached. Located along the top and bottom rails 226, 228 are a series of mounting through-holes 227, 229, respectively.

A top mounting bar 230 sandwiches the upper material flap 165 of the sponson 150 against the top rail 226. A series of through-holes 231 in the top mounting bar 230 corresponding to the top rail through-holes 227 provide attachment points for bolts 232. A corresponding series of attached nuts 233 that are preferably fixed to the bottom-side of the top rail 230 secure the bolts 232, thereby securing the tipper material flap 165. In the embodiment shown in FIGS. 1, 2 and 4, the top mounting bar 230 includes a plurality of separate pieces to accommodate the changing shape of the hull 200.

In the same manner, a bottom mounting bar 236 sandwiches the lower material flap 160 against the bottom rail 228. A series of through-holes 237 in the bottom mounting bar 236 corresponding to the bottom rail through-holes 229 provide attachment points for bolts 238. A corresponding series of attached nuts 235 that are preferably fixed to the top-side of the bottom rail 228 secure the bolts 238, thereby securing the lower material flap 160. The bottom rail 228 and bottom mounting bar 236 combination serve as a hard chine, which is formed when the sides and bottom of a vessel meet at an angle (as opposed to a "soft" chine, which is formed with the bottom gradually curves into the sides). The bottom mounting bar 236 also includes an angled portion 239 formed on the side toward the sponson 150. The angled portion 239 angles downward toward the water at angle 241, which in this embodiment is preferably about 28°. The downward angle 241 serves to protect the lower material flap 160 from a 90° abrasion angle, as well as deflect water to the outboard as the boat 100 moves over the surface of the water. Deflection of the water away from the sponson 150, and especially away from the attachment of the sponson 150 to the hull 200, helps minimize water seepage in between the sponson 150 and the hull 200. In addition, the water deflection assists in lifting the boat 100 for planing, and adds to the lateral stability and tracking of the boat 100, particularly during turns.

Figure 5:
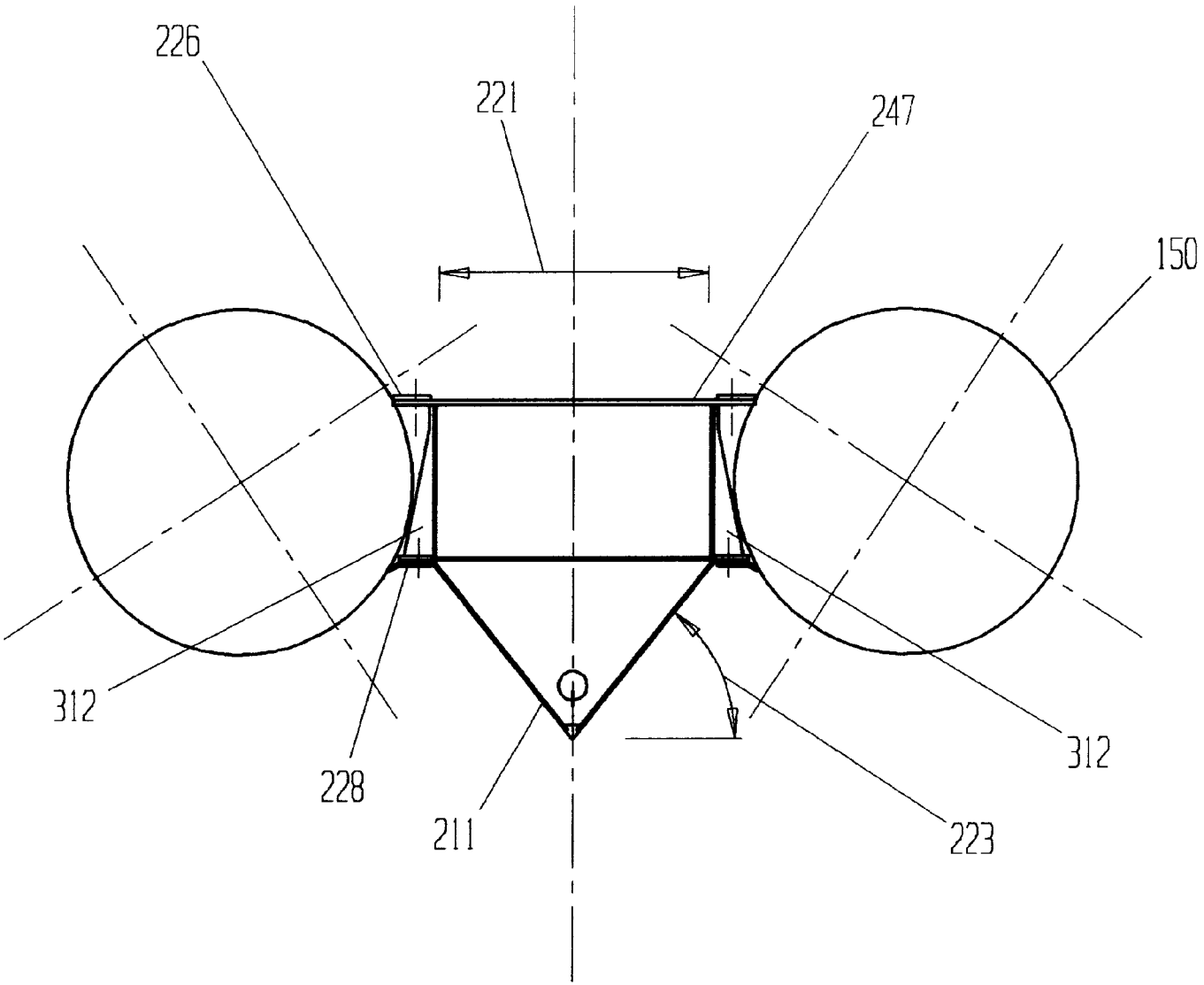
FIG. 5 is a front view of the first rib of the boat in FIG. 1.

Referring now to FIG. 5, the first rib 211 is shown looking aft toward the stem 112 of boat 100. Being the forwardmost of the ribs 210 located at the bow 201, rib 211 has the largest dead rise angle 223 of about 51.25° and narrowest width 221 of about 10 inches. The rib plate is different than the other ribs 210 because it does not include a profile bar 300 or a plurality of connectors 320. In addition, the rib plate sidewall portion 312 is configured differently to accommodate the position and angle of the sponson 150 at the bow 110. In the embodiment shown, the rib plate sidewall portion 312 angles inward toward the hull 200 from the bottom rail 228 to the top rail 226, which overhangs the narrowed sidewall portion 312. As the first rib 211 serves as part of the forward compartment 244, the cover plate 247 extends across the width 221 of the rib 211 from sidewall 220 to sidewall 220.

Figure 6:
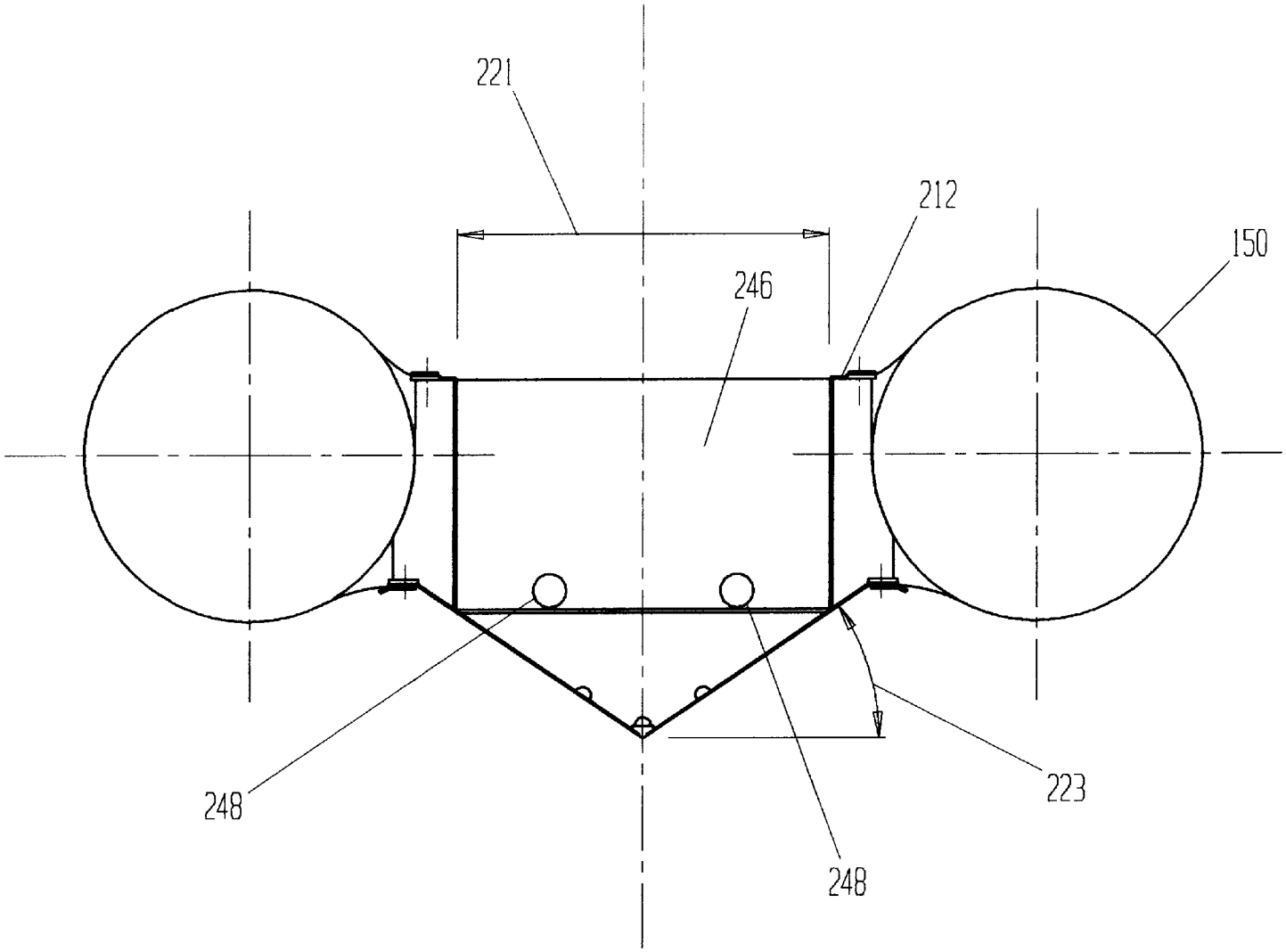
FIG. 6 is a front view of the second rib of the boat in FIG. 1.

In FIG. 6, the second rib 212 is shown, also looking aft. The second rib 212 is similar to the general rib configuration described above, except that it also has a larger dead rise angle 223 of about 34° and a narrower width 221 of about 22½ inches, and does not include either a profile bar 300 or a plurality of connectors 320. Additionally, the rib 212 forms the aft limit of compartment 244, and thus includes the aft plate 246 that has drainage holes 248.

Figure 7:
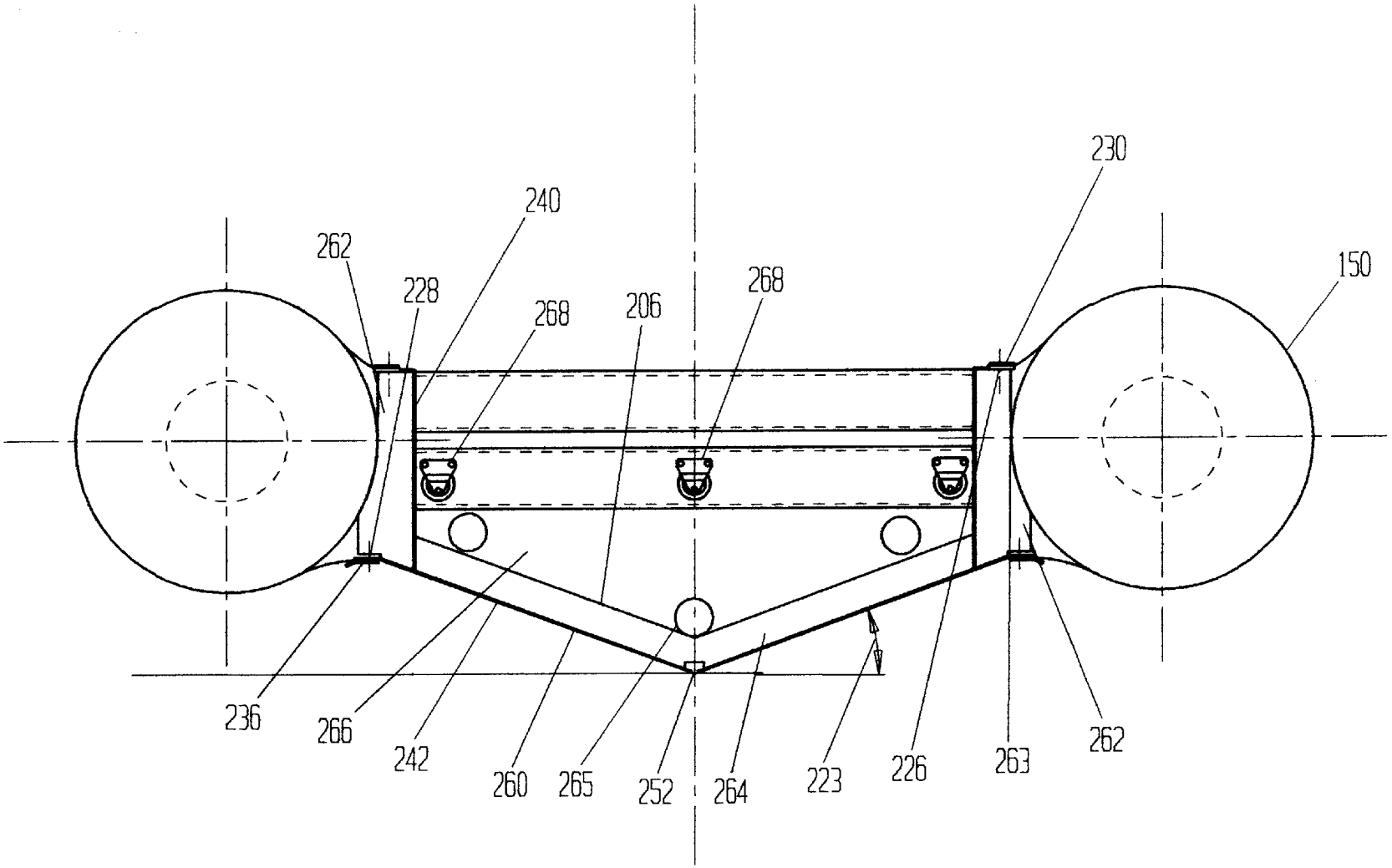
FIG. 7 is a front view of the transom of the boat in FIG. 1.

Referring now to FIG. 7, at the stem 112 of boat 100 is the transom 260. The transom 260 includes a back plate 266 having sidewall portions 262 and an angled keel portion 242. The outside edges of the sidewall portions are profiled to accommodate the sponson 150. Preferably, the back plate 266 is formed from aluminum, or other suitable material, and is about 3/16 inch thick. The top and bottom rails 226, 228 extend to the transom 260 for attachment of the sponson 150 along the full length of the hull 200 using top and bottom mounting bars 230. 236. The keel bar 252, the interior plates 240 forming the side 204 and deck 206, and the exterior plates 242 forming the vee-bottom 202, all abut and are attached to the back plate 266 as shown.

The back plate 266 includes two reinforcing bars 267, 269 positioned to provide rigidity and strength to the transom 260 when a motor or other propulsion device (not shown) is mounted to the stern 112 of the boat 100. The back plate 266 also includes a plurality of drainage holes 265 to facilitate removal of water that enters the interior of the boat 100, and a plurality of attachment hardware 268 to facilitate tie-down of fuel tanks, motors, or other items used at the stem 112 of the boat 100.

In one embodiment, the hull 200 includes the various components described above, all preferably formed from aluminum, although other suitable materials may also be used. When formed from aluminum, the resulting hull 200 is light weight, yet extremely durable and capable of handling a variety of environments. At the dimensions described above, the resulting hull 200 has a weight of about 385 pounds, and a total weight of 510 pounds with an air-filled sponson 150 and 630 pounds with a foam-filled sponson 150, both with a load capacity of 2000 pounds. These weights are comparable to a conventional RIB hull formed from fiberglass, yet the aluminum hulled boat 100 has a much higher degree of strength and durability, thereby making it a much more versatile and useful vessel for a variety of applications and purposes. At the same time however, the size and weight of the boat 100 make it easily lifted and transported with a minimum of effort and in a minimum of storage space.

Referring now to FIGS. 1, 2 and 8, in the embodiment shown, the boat 100 includes a number of additional features that are useful during operation, transport and/or storage of the boat 100. In order to facilitate lifting of the boat 100 using a four-point harness, or other lifting mechanism, four lifting eyes 280 are mounted to the sides 204 of the hull 200 at the deck 206. Two lifting eyes 280 are positioned across from each other at the third rib 213, and two lifting eyes are positioned across from each other at the ninth rib 219. Since the boat 100 has both a rigid hull bottom 202 and rigid sides 204, lifting of the boat 100 using a crane, davit or other mechanism is possible both when the boat 100 is empty and when it is loaded with gear or equipment, thus facilitating recovery of deployed boats 100. Such lifting of a loaded boat 100 is not possible with inflatable boats. Other features includes flat folding line cleats.

Figure 16:
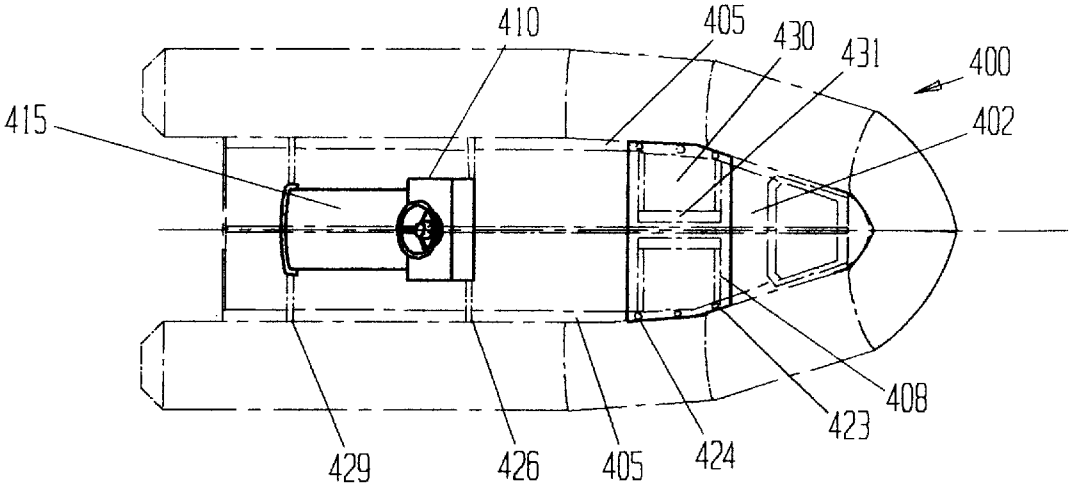
FIG. 16 is a top view of one embodiment of a boat in accordance with the present invention including an optional console, straddle seat and bench seat mounted the hull.
Figure 17:
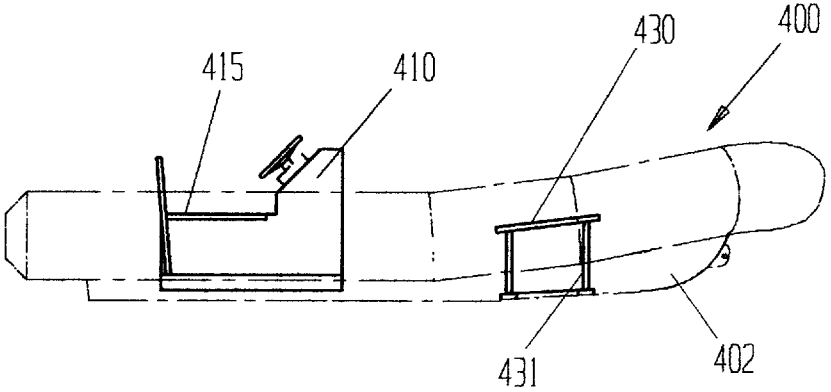
FIG. 17 is a side view of the boat in FIG. 16.

As best seen in FIGS. 1 and 2, the plurality of connectors, or threaded inserts, 320 inset in the ribs 210 are arranged in an organized pattern extending from the third rib 213 aft to the ninth rib 219. With eight connectors 320 per rib, there are preferably 56 total connectors 320 available for attachment of external components. These external components may include different seating arrangements, davits, cleats, weapon mounts, a steering console connectable to a motor, and/or fuel tanks. The boat 100 of the present invention provides extreme versatility and adaptability by accommodating reconfiguration of the boat 100 after fabrication. A user obtains the basic boat 100 including the adaptable hull 200 and one or more interchangeable sponsons 150 filled with a buoyant substance, such as air and/or foam. In addition, the user may obtain a number of external components usable in different situations.

in FIGS. 16 and 17, a boat 400 in accordance with the present invention is shown with a console 410 including a straddle seat 415 removably mounted to the hull 402 between the sixth rib 426 and the ninth rib 429. Such a straddle seat 415 and console 410 combination allows a user stability and control when piloting the boat 400, similar to personal watercraft. A battery storage compartment (not shown) may also be included in the console 410 to provide convenient, safe and out-of-the-way location of a marine battery for use with the console 410 and a motor (not shown). In addition, a bench type seat 430 is shown mounted to the top rails 405 between the third rib 423 and the fourth rib 424. Center supports 431 are also provided that extend from the seat 430 down to the hull 402 and connect to connectors 408 in ribs 423 and 424.

Figure 18:
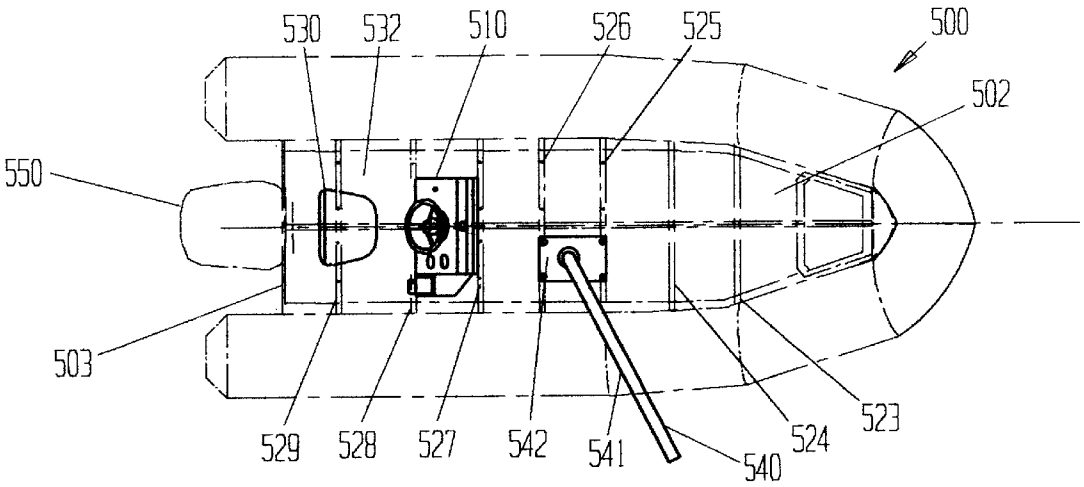
FIG. 18 is a top view of another embodiment of a boat in accordance with the present invention including a console, captain's chair, davit and outboard motor mounted to the hull.
Figure 19:
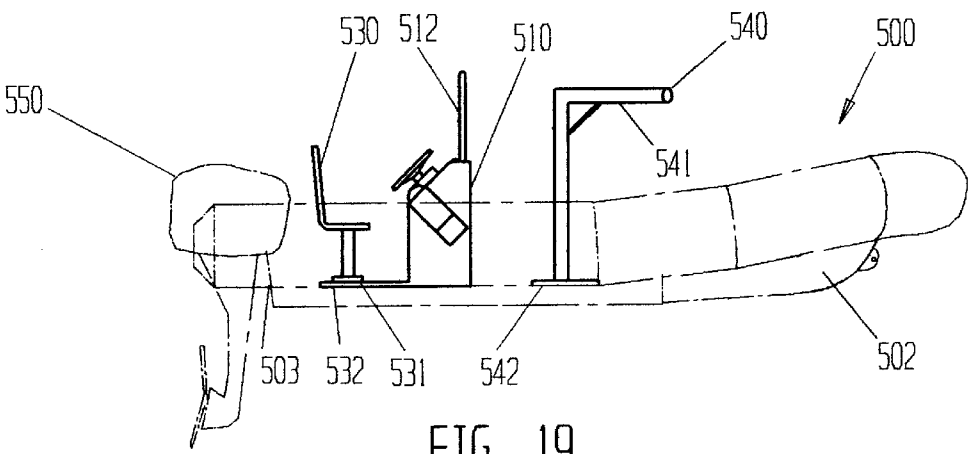
FIG. 19 is a side view of the boat in FIG. 18.

In FIGS. 18 and 19, a boat 500 also in accordance with the present invention is shown with a console 510 mounted to a hull 502 between a seventh rib 527 and an eighth rib 525. Mounted aft of the console 510 is a captain-s chair 530 attached to a mounting plate 532 by a support 531. The mounting plate 532 attaches to the hull 502 at the eighth and ninth ribs, 528 and 529, respectively The chair 530 may be adjustable toward and away from the console 510 for the convenience of the user. The console 510 includes a grab bar 512 that provides a support location for users sitting in or moving about the boat 500. An outboard motor 550 is also shown mounted to a transom 503 of the hull 502. Preferably, the motor 500 is electrically connected to the console 510 to provide ease of motor control. Additionally, a davit 540 is mounted to the hull 502 at base plate 542 between a fifth and sixth ribs, 525 and 526, respectively. The davit 540 includes a lifting beam 541 that is rotatably connected to base plate 542, allowing the lifting beam 541 to be moved over the side of the boat 500 or over the interior of the hull 502. The davit 540 is available for lifting items and heavy loads, such as diving equipment, dead bodies, or salvaged items, into and out of the boat 500.

Figure 20:
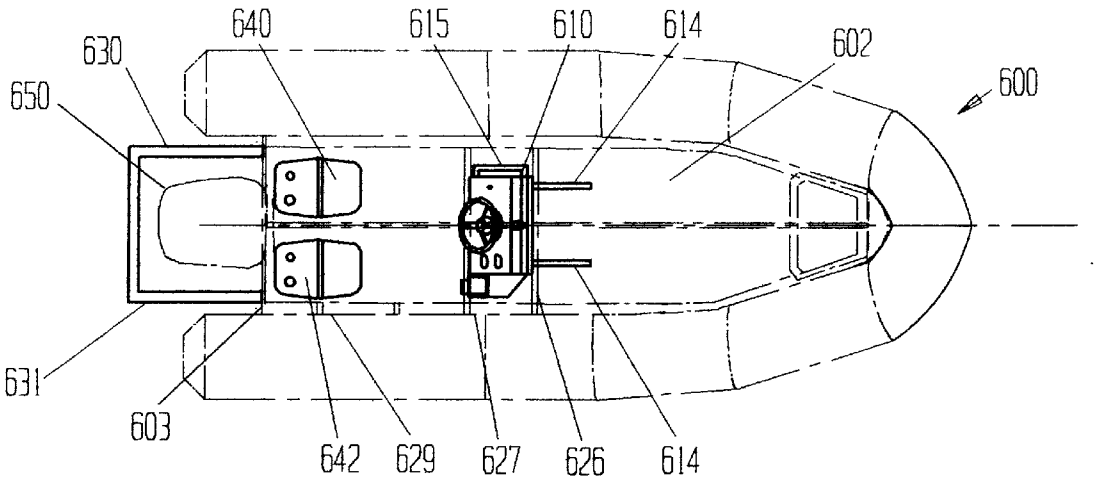
FIG. 20 is a top view of yet another embodiment of a boat in accordance with the present invention including a console, an outboard motor, a motor guard and a pair of fuel tanks mounted to the hull.
Figure 21:
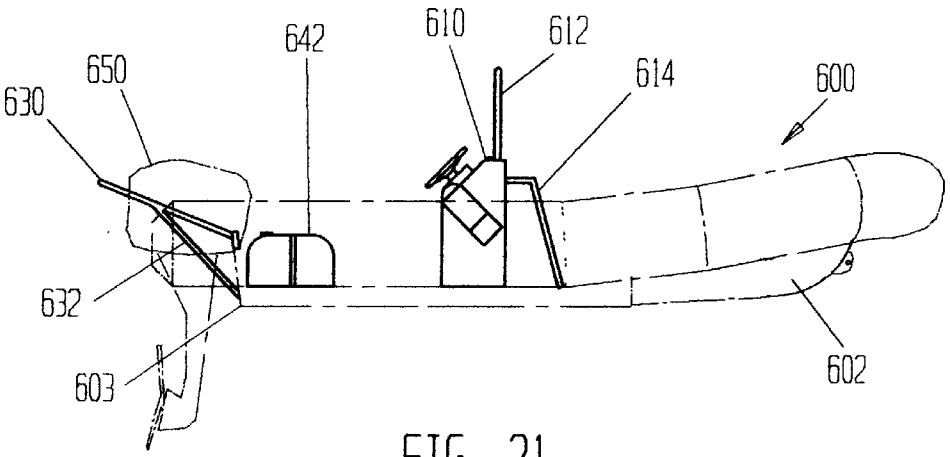
FIG. 21 is a side view of the boat in FIG. 20.

In FIGS. 20 and 21, a boat 600 also in accordance with the present invention is shown having a console 610 mounted to a hull 602 between a sixth rib 626 and a seventh rib 627. The console 610 also includes a number of grab bars 612. 614,615 extending off of the console 610 that provide support locations for users in the boat 600. An outboard motor 650 is shown mounted to a transom 603 of the hull 602. Surrounding the motor 650 and positioned somewhat above the motor 650 is a motor guard 630 that includes a generally 'U' shaped pipe or tube mounted to the hull 602 or transom 603. An angular support piece 632 is also included to provide vertical stability to the motor guard 630. The motor 650 is preferably connected electrically to the console 610. Also included are a pair of fuel tanks 640, 642 positioned adjacent the transom 603 and motor 650. These tanks 640, 642 may be strapped down to the hull 602 at a ninth rib 629, or may be strapped to the transom 603.

As would be apparent to one of skill in the art, numerous components and combinations of components are possible for use with the boat of the present invention. Such components may be located at various positions within the hull of the boat, which, when combined with the other components available for use with the boat, allows for repeated reconfiguration of the boat to meet the needs and purposes of the boat on a mission by mission basis. These components, and the various combinations thereof, are within the scope and spirit of the present invention.

The boat 100 preferably also includes an instructional manual (not shown) that provides directions for reconfiguring the boat 100 for multiple purposes using the many components available for use with the boat 100. Such instructions illustrate the various mounting locations for different components using the predetermined organized pattern of connectors, thereby providing relatively fast and easy adaptation of the boat 100 for a specific intended use. Such instructions also provide direction in using additional components later developed for use with the boat 100.

Conventional RIBs on the other hand, may often be ordered from the manufacturer in various user defined configurations, specifying certain options as needed or desired for the intended use of the boat. However, once purchased and fabricated, the configuration of the boat is not modifiable to meet new or different needs. Although such initial ordering versatility may be beneficial when a boat is being put chased for a single or very limited purpose, such limitations are too constraining for most users, especially for organizations having limited budgets and numerous needs.

The adaptable, multi-purpose boat 100 of the present invention provides post-fabrication versatility not presently found in other commercially available boats. The basic structure of the hull includes ribs connected by thin plates and a keel bar. This structure provides a very strong yet light weight hull capable of withstanding the impact of rough seas, beaching, and contact with other objects. In the embodiment shown, the aluminum boat of the present invention weighs a similar amount as a conventional RIB formed of less strong fiberglass. The strength of the hull also allows for use of a larger motor, providing more speed and withstanding harsher treatment. The addition of the removable and interchangeable buoyant sponsons results in an extremely seaworthy vessel capable of high speeds in open water, as well as in shallow coastal areas or rivers. Beyond the basic structure, the boat provides the unique addition of a plurality of connectors set in a pattern that facilitates post-fabrication reconfiguration of the boat using multiple external components. Such adaptability makes the boat of the present invention extremely useful for users needing a single boat usable for multiple purposes.

Although the present invention has been described with reference to preferred embodiments, workers skilled in the art will recognize that changes may be made in form and detail without departing from the spirit and scope of the invention. In addition, the invention is not to be taken as limited to all of the details thereof as modifications and variations thereof may be made without departing from the spirit or scope of the invention.

What is claimed is:

1. An adaptable, multi-purpose boat comprising:

a. a buoyant sponson; and b. a rigid hull removably connected to the buoyant sponson, the rigid hull including a plurality of rigid ribs, each constructed from a pair of sidewall portions and a 'V' angled keel portion, connected to form sides, a keel, and a 'V' angled bottom interposed between the sides and the keel, the plurality of rigid ribs including a plurality of hull connectors arranged in a predetermined organized pattern, the rigid hull further including thin plates connecting the plurality of rigid ribs to form interior sides, an interior synclinal angled deck on the bottom of the boat, and an exterior surface on the angled bottom of the boat, with the sidewall portions of the rigid ribs externally protruding beyond the interior sides of the boat, wherein a variety of external components may be removably fastened to the boat using at least one of the plurality of hull connectors such that the boat is repeatedly reconfigurable to adapt to multiple post-fabrication purposes.

2. The boat of claim 1, wherein the sidewall portions that externally protrude are profiled to mate a surface of the buoyant sponson.

3. An adaptable, multi-purpose boat comprising:

a. a buoyant sponson; and b. a rigid hull removably connected to the buoyant sponson, the rigid hull including a plurality of rigid ribs, each constructed from a pair of sidewall portions and a 'V' angled keel portion, connected to form sides, a keel, and a 'V' angled bottom interposed between the sides and the keel, the plurality of rigid ribs including a plurality of hull connectors arranged in a predetermined organized pattern and a top rail and a bottom rail extending around the boat above and below the sidewall portions of the rigid ribs, respectively, the rigid hull further including thin plates connecting the plurality of rigid ribs to form interior sides, an interior synclinal angled deck on the bottom of the boat, and an exterior surface on the angled bottom of the boat wherein a variety of external components may be removably fastened to the boat using at least one of the plurality of hull connectors such that the boat is repeatedly reconfigurable to adapt to multiple post-fabrication purposes.

4. The boat of claim 3, wherein the buoyant sponson is removably connected to the rigid hull at the top and bottom rails.

5. The boat of claim 4, wherein the buoyant sponson comprises a plurality of material flaps extending from a sidewall of the buoyant sponson, and wherein the plurality of material flaps are removably secured to the rigid hull at the top and bottom tails.

6. The boat of claim 5, wherein the boat further comprises a plurality of top mounting bars and a plurality of bottom mounting bars; wherein the plurality of top and bottom mounting bars and the top and bottom rails each include a plurality of mounting holes formed through the mounting bars and rails, such that the mounting holes in the top and bottom mounting bars are alignable with the mounting holes in the top and bottom rails, respectively; and wherein the material flaps of the buoyant sponson are sandwiched between the plurality of top and bottom mounting bars and the top and bottom rails bolted together, respectively, at the plurality of aligned mounting holes.

7. The boat of claim 6, wherein the plurality of bottom mounting bars each include an angled portion formed to angle away from the buoyant sponson when the plurality of bottom mounting bars are attached to the boat, such that as the boat rides along the water, the angled portion diverts water away from the buoyant sponson and minimizes water introduction into a space formed between the buoyant sponson and the rigid hull.

8. An adaptable, multi-purpose boat comprising:

a. a buoyant sponson; and b. a rigid hull removably connected to the buoyant sponson, the rigid hull including:

i) a plurality of rigid ribs, each constructed from a pair of sidewall portions and a 'V' angled keel portion, connected to form sides, a keel, and a 'V' angled bottom interposed between the sides and the keel, the plurality of rigid ribs including a plurality of hull connectors arranged in a predetermined organized pattern; and ii) plates forming interior sides, an interior synclinal angled deck on the bottom of the boat, and an exterior surface on the angled bottom of the boat, the sidewall portions of the rigid ribs externally protruding beyond the interior sides of the boat and being profiled to mate with a surface of the buoyant sponson, wherein a variety of external components may be removably fastened to the boat using at least one of the plurality of hull connectors such that the boat is repeatedly reconfigurable to adapt to multiple post-fabrication purposes.

* * * * *